US010625928B2

(12) United States Patent
Christy

(10) Patent No.: US 10,625,928 B2
(45) Date of Patent: Apr. 21, 2020

(54) SALT STORAGE AND APPLICATION RECEPTACLE

(71) Applicant: THE TORO COMPANY, Bloomington, MN (US)

(72) Inventor: Jody Christy, Iron Mountain, MI (US)

(73) Assignee: THE TORO COMPANY, Bloomington, MN (US)

( * ) Notice: Subject to any disclaimer, the term of this patent is extended or adjusted under 35 U.S.C. 154(b) by 67 days.

(21) Appl. No.: 16/034,014

(22) Filed: Jul. 12, 2018

(65) Prior Publication Data

US 2019/0016523 A1 Jan. 17, 2019

Related U.S. Application Data

(60) Provisional application No. 62/532,614, filed on Jul. 14, 2017.

(51) Int. Cl.
*B65D 83/06* (2006.01)
*B65D 25/32* (2006.01)

(52) U.S. Cl.
CPC ..... *B65D 83/06* (2013.01); *B65D 25/32* (2013.01)

(58) Field of Classification Search
CPC ..... B65D 83/06; B65D 25/32
USPC ..... 239/650, 652, 653; 222/565
See application file for complete search history.

(56) References Cited

U.S. PATENT DOCUMENTS 4,596,363 A * 6/1986 Wellard ..... A01C 7/02 222/565
4,773,568 A * 9/1988 Schaefer ..... A01C 7/02 239/652
5,000,387 A * 3/1991 Szuhay ..... A47G 19/24 222/565
5,372,304 A * 12/1994 Sheen ..... A01C 15/02 239/652

* cited by examiner

*Primary Examiner* — Steven J Ganey
(74) *Attorney, Agent, or Firm* — Marshall, Gerstein & Borun LLP

(57) ABSTRACT

An apparatus for applying a de-icing material to a surface includes a receptacle and a handle. The receptacle includes a base portion and a sidewall portion coupled to the base. At least a portion of the handle is coupled to the sidewall portion. The apparatus further includes at least one opening that extends through the sidewall. The opening is dimensioned to accommodate passage of the de-icing material. Upon rotating the handle, the de-icing material is expelled from the receptacle through the opening.

17 Claims, 3 Drawing Sheets

SALT STORAGE AND APPLICATION RECEPTACLE

FIELD OF THE DISCLOSURE

The present disclosure generally relates to salt storage and spreading devices and, more particularly, to a hand-held bucket for de-icing surfaces.

BACKGROUND

Spreaders for de-icing materials, such as salt, are critical for winter snow and ice removal. In some smaller environments, such as, for example, households, office buildings, restaurants and store entranceways, handheld apparatuses can be used to assist in applying ice to surfaces such as sidewalks, stairs, and other walkways. Some known handheld receptacles utilize a spout disposed at the top of the device and operate by "pouring" the de-icing material therefrom. However, these devices oftentimes cannot adequately distribute the de-icing material across large surfaces, and can result in spillage of too much de-icing material, causing undesirable localized areas having large quantities of de-icing material, whereas other areas may have insufficient de-icing material to adequately melt the ice.

SUMMARY

The present disclosure is directed to a handheld de-icing material (e.g., salt) storage and application receptacle or container. The container is designed to allow for the application of salt to desired surfaces by simply twisting or rotating the container, thereby utilizing centripetal force to expel the salt therefrom.

In accordance with an embodiment, an apparatus for applying a de-icing material to a surface includes a receptacle and a handle. The receptacle includes a base portion and a sidewall portion coupled to the base. At least a portion of the handle is coupled to the sidewall portion. The apparatus further includes at least one opening that extends through the sidewall. The opening is dimensioned to accommodate passage of the de-icing material. Upon rotating the handle, the de-icing material is expelled from the receptacle through the opening.

In some approaches, the apparatus may include at least one sealing device that is removably coupled to the receptacle to restrict the de-icing material from being expelled from the receptacle.

In some examples, the base portion may have a generally conical shape. The base portion may have a generally angled orientation that causes the de-icing material to be urged towards the sidewall portion of the receptacle.

In some of these examples, the opening may have an outer dimension of between approximately 1 mm and approximately 30 mm. The opening may extend through the sidewall at an angle of approximately 90 degrees. In other approaches, the opening may extend obliquely through the sidewall. Further, in some examples, the apparatus may include a number of openings disposed on the sidewall portion of the receptacle in any number of configurations.

In some approaches, the handle may be in the form of an elongated member that is coupled to the sidewall portion of the receptacle at a plurality of locations.

In accordance with another embodiment, an approach for applying a de-icing material to a surface includes providing a receptacle to accommodate the de-icing material having a base portion, a sidewall portion coupled to the base, and a handle coupled to the sidewall portion, whereby the sidewall portion has at least one opening extending therethrough. At least one sealing device is removed from the sidewall portion of the receptacle to expose the at least one opening extending through the sidewall portion. Upon rotating the handle, the de-icing material is expelled from the receptacle via the at least one opening.

BRIEF DESCRIPTION OF THE DRAWINGS

The above needs are at least partially met through provision of the salt storage and application receptacle described in the following detailed description, particularly when studied in conjunction with the drawings, wherein.

Figure 1:
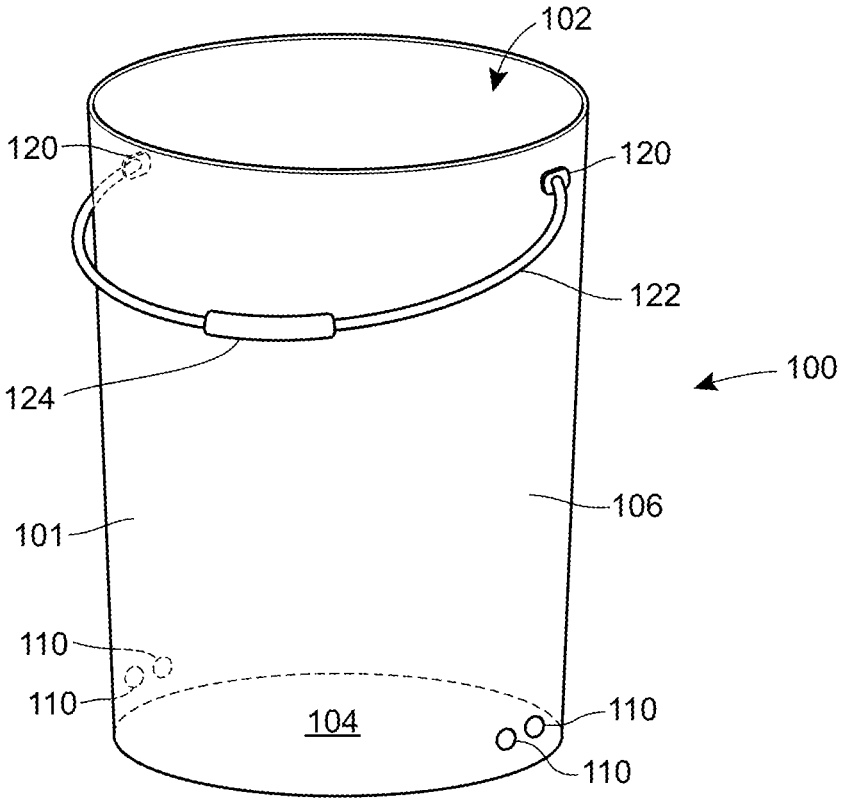
FIG. 1 illustrates a perspective view of an example salt storage and application receptacle in accordance with various embodiments of the present disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Referring now to the drawings, an apparatus 100 for applying a de-icing material 130 such as, for example, salt or a similar material (in the form of a pellet, rock, stone, etc.) includes a receptacle, container, or bucket 101 that includes a base portion 104 and a sidewall portion 106. The receptacle 101 can be formed from any number of materials such as, for example, polymers, metals, composites, ceramics, and the like. In some examples, the base portion 104 and the sidewall portion 106 have a one-piece construction; and in other examples, the base portion 104 and the sidewall portion 106 are discrete components that are coupled together by any number of approaches. In the illustrated examples, the sidewall portion 106 is generally cylindrical and/or frustoconical, but it is understood that the sidewall portion 106 may have any desired shape or orientation. The base portion 104 and the sidewall portion 106 cooperate to define a cavity 102 in which the de-icing material 130 is disposed.

Figure 2:
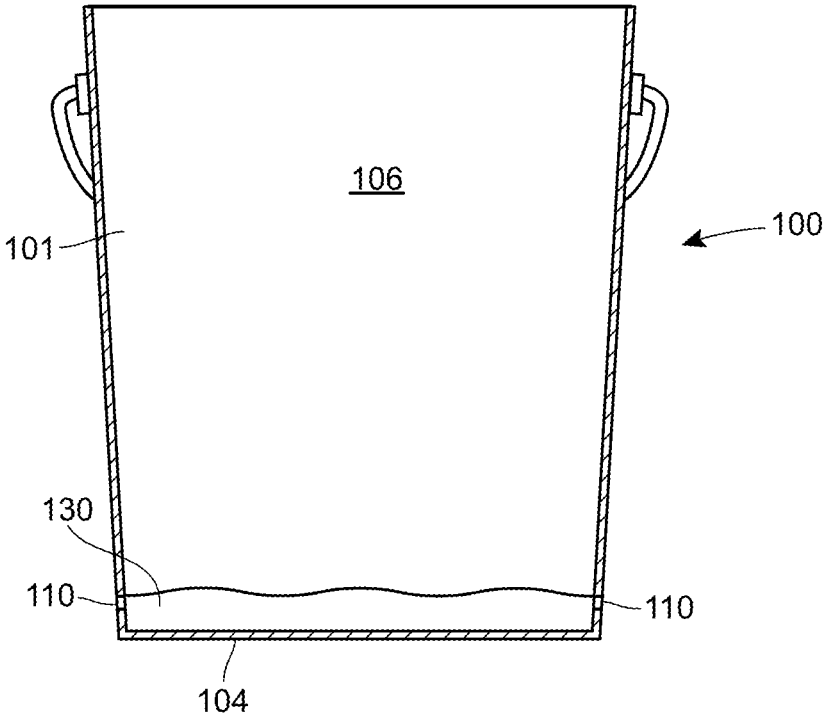
FIG. 2 illustrates a cross-sectional front elevation view of an example salt storage and application receptacle in accordance with various embodiments of the present disclosure.
Figure 3:
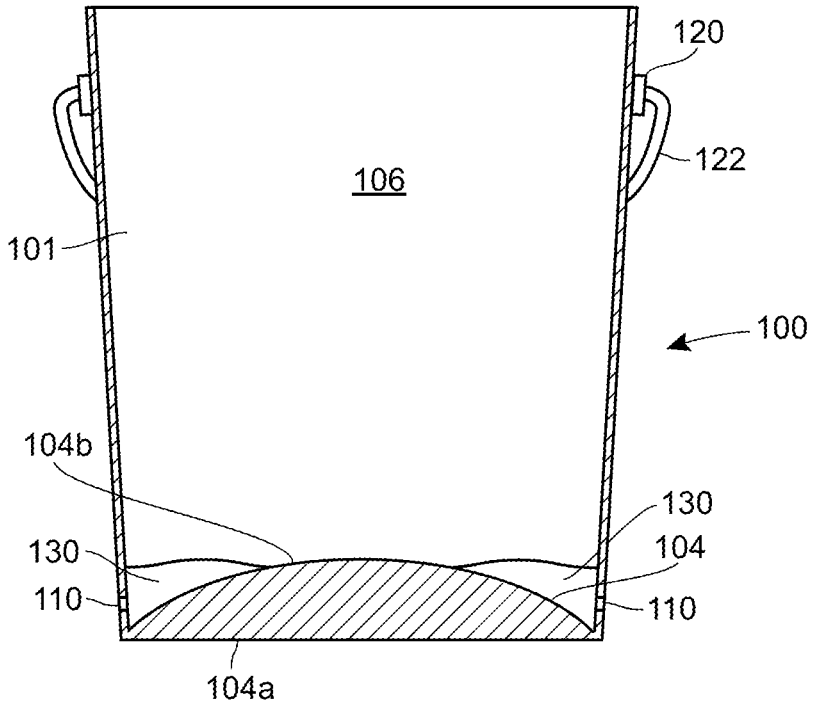
FIG. 3 illustrates a cross-sectional front elevation view of an alternative salt storage and application receptacle in accordance with various embodiments of the present disclosure.
Figure 4:
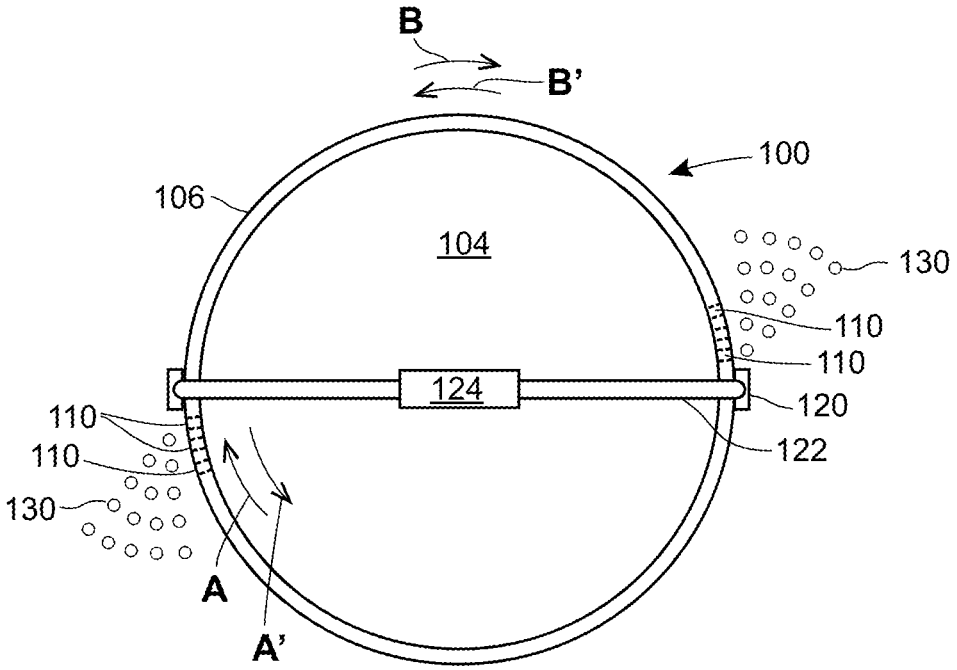
FIG. 4 illustrates a top plan view of an example salt storage and application receptacle in accordance with various embodiments of the present disclosure.

The apparatus 100 further includes a handle 122 coupled to the sidewall portion 106 via the handle attachment portion 120. In some examples, and as illustrated in FIGS. 2-4, the handle 122 may be in the form of an elongated member which is coupled to the sidewall portion 106 at a number of locations 120. For example, the handle 122 may be rotatably coupled to the sidewall portion 106 of the receptacle 101 at the handle attachment portion or portions 120. In some examples, the handle 122 may include additional features such as a gripping portion 124 which may include any number of ergonomic features that provide a comfortable experience when using the apparatus 100.

The apparatus 100 further includes at least one opening 110 extending through the sidewall portion 106. Generally speaking, the opening or openings 110 are disposed at a lower portion of the sidewall portion 106 near the base portion 104. The opening or openings 110 accommodate passage of the de-icing material 130 such that it may be applied to desired surfaces. It is understood that any number of openings 110 may be disposed on the sidewall portion 106 as desired to cause more or less de-icing material 130 to be expelled from the receptacle 101. In some examples, the opening or openings 110 may be positioned directly below or within proximity of the handle attachment portion or portions 120. This positioning may maximize efficiency of expelling the de-icing material 130 from the receptacle, as will be described in further detail below.

The opening or openings 110 may be of any shape, size, or dimension and can be dimensioned according to the shape, size, and/or dimension of the particular de-icing material being used such that the opening or openings 110 are larger than individual granules of the particular de-icing material. For example, the opening or openings may have a length between approximately 1 mm and approximately 30 mm. Specifically, if the de-icing material 130 is a rock salt or similar material having a granule size ranging between approximately 2 mm and approximately 20 mm, the opening or openings 110 may be approximately 25 mm in length such that the de-icing material 130 does not spill out of the opening or openings 110 unless the receptacle 101 is rotated in a manner described below. In these examples, it is understood that the de-icing material 130 will likely have a non-uniform granule size, thus the opening or openings 110 must be slightly larger than the largest granule. Other examples are possible.

In operation, and as illustrated in FIG. 4, a user grips the handle 122 at a location along the longitudinal length (e.g., at the gripping portion 124). By rotating or twisting the handle 122 in alternating directions indicated by arrows A and A', the receptacle 101 will also twist in a corresponding direction (indicated by arrows B and B', respectively). This rotation exerts a centripetal force on the de-icing material 130 which urges the de-icing material towards the sidewall portion 106. Because the opening or openings 110 are larger than the individual granules of the de-icing material 130, the de-icing material 130 is then expelled from the receptacle 101 and thus falls onto a desired surface to be de-iced. It is understood that the non-uniformity in size of the de-icing material 130 serves to restrict the material from spilling out of the opening or openings 110 prior to rotation of the handle 122.

As illustrated in FIG. 2, the base portion 104 may have a generally flat or horizontal configuration. However, in some examples, and as illustrated in FIG. 3, the base portion 104 may have a generally conical shape or other angled configuration. Such a configuration may assist in urging the de-icing material 130 towards the sidewall portion 106 to ensure that all of the de-icing material 130 is expelled from the receptacle 101. As illustrated in FIG. 3, in these examples, an outer surface 104*a* of the base portion 104 may remain generally flat or horizontal, but in other examples, the outer surface 104*a* may mirror the curved or angled shape of the inner surface 104*b*. Other examples of shapes and/or configurations are possible.

In examples where the base portion 104 has a generally conical shape or other angled configuration, the curved or angled surface may terminate at the sidewall portion 106 a plane that is equal to the location of the opening or openings 110. As such, upon expulsion of the de-icing material 130, little to no de-icing material 130 will remain in the receptacle 101. Accordingly, the receptacle reduces and/or eliminates the possibility of de-icing material 130 being unable to exit the opening or openings 110 due to a small quantity of the de-icing material 130 being positioned below the opening or openings 110.

In some examples, the opening or openings 110 may be spaced apart and/or dimensioned in a manner that provides for even distribution across a desired surface. Further, an expulsion rate of the de-icing material 130 can be modified based on the number, size, and shape of the openings 110. As a non-limiting example, by disposing multiple, larger openings 110 closer together, upon twisting the handle 122, a large amount of de-icing material 130 may be expelled from the receptacle, thus creating a more dense distribution pattern. Conversely, by using smaller openings 110 that are spaced further apart, less de-icing material 130 will be expelled from the receptacle 101, thus resulting in a sparse distribution pattern.

In some of these examples, the opening or openings 110 may initially be partially or fully perforated and may include a portion of material that blocks the opening or openings 110 and restricts the de-icing material 130 from preemptively exiting the apparatus 100. In these examples, the material blocking the opening or openings 110 may be manually moved or removed (e.g., "punched out" via a perforated member) to allow the de-icing material 130 to exit the apparatus 100. In some examples, the opening or openings 110 may include a threaded portion that accommodate a cap or cover to allow the apparatus 100 to be reused after it is emptied. Other examples and/or configurations are possible.

Figure 5:
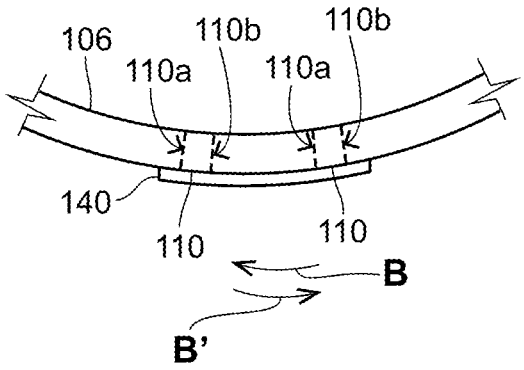
FIG. 5 illustrates a top plan view of an example salt storage and application receptacle in accordance with various embodiments of the present disclosure.
Figure 6:
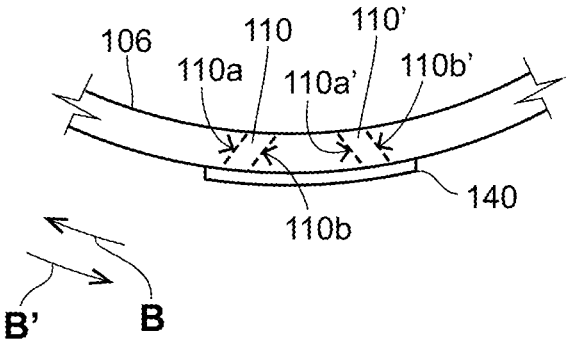
FIG. 6 illustrates a top plan view of an example salt storage and application receptacle in accordance with various embodiments of the present disclosure.

As illustrated in FIGS. 5 and 6, the apparatus 100 may also include at least one sealing device 140. The sealing device 140 may be removably coupled to the receptacle 101 to restrict the de-icing material from being expelled from the opening or openings 110. For example, the sealing device 140 may be a sticker or other label removably coupled to the sidewall portion 106 and/or the base portion 106. In other examples, the sealing device may be a member having a protrusion that is dimensioned, shaped, and sized to be press fit into the opening or openings 110 to provide a seal. Other examples are possible.

In some of these examples, the sealing device 140 may be reusable; that is, upon using the apparatus 100, the sealing device 140 may be reapplied to cover the opening or openings 110.

As illustrated in FIG. 5, the opening or openings 110 may extend through the sidewall portion 106 at an angle of approximately 90 degrees. Accordingly, when the receptacle 101 is rotated clockwise (as denoted by arrow B), individual granules of the de-icing material 130 will first contact the surface 110*b* of the opening or openings 110 before being expelled from the receptacle 101. When the receptacle 101 is rotated counter-clockwise (as denoted by arrow B'), individual granules of the de-icing material 130 will first contact the surface 110*a* of the opening or openings 110 before being expelled from the receptacle 101.

As illustrated in FIG. 6, the opening or openings 110 extend obliquely through the sidewall portion 106. In FIG. 6, a first opening 110 extends obliquely through the sidewall portion 106 in a first direction, and a second opening 110' extends obliquely through the sidewall portion 106 in a second direction. With regard to the first opening 110, when the receptacle 101 is rotated clockwise (as denoted by arrow B), individual granules of the de-icing material 130 first contact the surface 110*b* of the opening 110, which at least partially restricts or prevents the granule de-icing material 130 from being expelled from the receptacle 101. Conversely, with regard to the second opening 110', when the receptacle 101 is rotated clockwise, individual granules of the de-icing material 130 make little to no contact with either of the surfaces 110*a*', 110*b*' before being expelled from the receptacle 101. However, when the receptacle 101 is rotated counter-clockwise (as denoted by arrow B'), with regard to the first opening 110, individual granules of the de-icing material 130 make little to no contact with either of the surfaces 110*a*, 110*b* before being expelled from the receptacle 101, but individual granules of the de-icing material 130 will contact the surface 110*a*' of the opening 110', which at least partially restricts or prevents the granule de-icing material 130 from being expelled from the receptacle 101. In other words, the expulsion rate of the de-icing material 130 can further be modified by disposing openings 110 at desired angles relative to the sidewall portion 106.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. An apparatus for applying a de-icing material to a surface, comprising:

a receptacle having a base portion and a sidewall portion coupled to the base portion;

a handle coupled to the sidewall portion; and at least one opening extending through the sidewall portion, the at least one opening being dimensioned to accommodate passage of the de-icing material;

wherein the base portion has a generally angled orientation to urge the de-icing material towards the sidewall portion of the receptacle, wherein upon rotating the handle, the de-icing material is expelled from the receptacle via the at least one opening.

2. The apparatus of claim 1, further comprising at least one sealing device adapted to be removably coupled to the receptacle to restrict the de-icing material from being expelled from the at least one opening.

3. The apparatus of claim 2, wherein the at least one sealing device comprises a threaded portion to be threadably coupled to the at least one opening.

4. The apparatus of claim 2, wherein the at least one sealing device comprises a perforated member.

5. The apparatus of claim 1, wherein the base portion comprises at least one of a generally conical shape.

6. The apparatus of claim 1, wherein the at least one opening has an outer dimension between approximately 1 mm and approximately 30 mm.

7. The apparatus of claim 1, wherein the at least one opening extends through the sidewall portion at an angle of approximately 90 degrees.

8. The apparatus of claim 1, wherein the at least one opening extends obliquely through the sidewall portion.

9. The apparatus of claim 1, wherein the handle comprises an elongated member coupled to the sidewall portion at a plurality of locations.

10. A method of applying a de-icing material to a surface, comprising:

providing a receptacle having a base portion, a sidewall portion coupled to the base portion, and a handle coupled to the sidewall portion, the sidewall portion having at least one opening extending therethrough, the receptacle accommodating the de-icing material;

removing at least one sealing device from the sidewall portion of the receptacle to expose the at least one opening extending through the sidewall portion; and rotating the handle to expel the de-icing material from the receptacle via the at least one opening;

wherein the base portion comprises a conical portion that automatically urges the de-icing material towards the sidewall portion of the receptacle.

11. The method of claim 10, further comprising extending the at least one opening through the sidewall portion at an angle of approximately 90 degrees.

12. The method of claim 10, further comprising extending the at least one opening through the sidewall portion at an oblique angle.

13. The method of claim 10, wherein the at least one sealing device is threadably removed from the at least one opening.

14. The method of claim 10, wherein the at least one sealing device is punched out from the at least one opening.

15. An apparatus for applying a de-icing material to a surface, comprising:

a receptacle having a base portion and a sidewall portion coupled to the base portion;

a handle coupled to the sidewall portion;

at least one opening extending through the sidewall portion, the at least one opening being dimensioned to accommodate passage of the de-icing material; and at least one sealing device adapted to be removably coupled to the receptacle to restrict the de-icing material from being expelled from the at least one opening, the at least one sealing device comprising a threaded portion to be threadably coupled to the at least one opening;

wherein upon rotating the handle, the de-icing material is expelled from the receptacle via the at least one opening.

16. An apparatus for applying a de-icing material to a surface, comprising:

a receptacle having a base portion and a sidewall portion coupled to the base, the base portion portion comprising at least one of a generally conical shape;

a handle coupled to the sidewall portion; and at least one opening extending through the sidewall portion, the at least one opening being dimensioned to accommodate passage of the de-icing material;

wherein upon rotating the handle, the de-icing material is expelled from the receptacle via the at least one opening.

17. A method of applying a de-icing material to a surface, comprising:

providing a receptacle having a base portion, a sidewall portion coupled to the base portion, and a handle coupled to the sidewall portion, the sidewall portion having at least one opening extending therethrough, the receptacle accommodating the de-icing material;

removing at least one sealing device from the sidewall portion of the receptacle to expose the at least one opening extending through the sidewall portion; and rotating the handle to expel the de-icing material from the receptacle via the at least one opening, wherein at least one sealing device is threadably removed from the at least one opening.

* * * * *